US008695120B2

(12) United States Patent
Green et al.

(10) Patent No.: US 8,695,120 B2
(45) **Date of Patent: *Apr. 15, 2014**

(54) GLOVE

(75) Inventors: Daniel Allan Green, Squamish (CA); Carl Moriarty, North Vancouver (CA)

(73) Assignee: Arc' Teryx Equipment Inc., North Vancouver, BC (CA)

( * ) Notice: Subject to any disclaimer, the term of this patent is extended or adjusted under 35 U.S.C. 154(b) by 935 days.

This patent is subject to a terminal disclaimer.

(21) Appl. No.: 12/689,928

(22) Filed: Jan. 19, 2010

(65) Prior Publication Data

US 2010/0186141 A1 Jul. 29, 2010

Related U.S. Application Data

(63) Continuation-in-part of application No. 12/190,195, filed on Aug. 12, 2008.

(51) Int. Cl.
*A41D 19/00* (2006.01)

(52) U.S. Cl.
USPC ..... 2/163; 2/159; 2/161.1; 2/161.6; 2/169

(58) Field of Classification Search
USPC ..... 2/159, 169, 161.1, 161.3, 161.5, 161.6, 2/161.8, 163, 167
See application file for complete search history.

(56) References Cited

U.S. PATENT DOCUMENTS

| | | | | |
|---|---|---|---|---|
| 199,738 | A | | 1/1878 | Parker |
| 1,252,900 | A | | 1/1918 | Grinnell |
| 1,377,338 | A | | 5/1921 | Grinnell |
| 2,447,951 | A | | 8/1948 | Lindfelt |
| 2,864,091 | A | | 12/1958 | Schneider |
| 3,258,782 | A | | 7/1966 | Turnidge et al. |
| 3,366,973 | A | | 2/1968 | Israel |
| 3,703,007 | A | | 11/1972 | Stewart |
| 4,453,275 | A | | 6/1984 | Kawada |
| 4,525,877 | A | * | 7/1985 | Chong ..... 2/161.1 |
| 4,654,896 | A | | 4/1987 | Rinehart |
| 4,733,413 | A | | 3/1988 | Dykstra |
| 4,987,614 | A | | 1/1991 | Murray |
| 5,568,656 | A | | 10/1996 | Kim |
| 5,659,899 | A | | 8/1997 | Soter et al. |
| 5,682,614 | A | | 11/1997 | Lazarus |
| 5,752,279 | A | | 5/1998 | Hochmuth |
| 5,774,897 | A | | 7/1998 | Hochmuth |
| 6,094,748 | A | | 8/2000 | Kindler |
| 6,415,447 | B1 | | 7/2002 | Frazier |
| 7,287,285 | B2 | | 10/2007 | Jaeger et al. |
| 2004/0031085 | A1 | | 2/2004 | Widdemer |
| 2004/0250335 | A1 | | 12/2004 | Jaeger et al. |
| 2010/0037362 | A1 | | 2/2010 | Green et al. |

FOREIGN PATENT DOCUMENTS

| | | | |
|---|---|---|---|
| GB | 996815 | A1 | 6/1965 |
| WO | WO-99/64240 | A1 | 12/1999 |

* cited by examiner

*Primary Examiner* — Khoa Huynh
*Assistant Examiner* — Sally Haden
(74) *Attorney, Agent, or Firm* — Greenblum & Bernstein, P.L.C.

(57) ABSTRACT

The invention is directed to a glove that includes an outer shell having several finger shells. At least one finger shell includes first, second, and third tongues, the first tongue forming the palm portion of the finger shell, and the second and third tongues forming the back and side portions of the finger shell. The tongues are joined together at their adjacent edges. The glove can further include waterproof strips overlapping the adjacent edges and fastened to the edges. The invention is also directed to a method of manufacturing the glove.

44 Claims, 5 Drawing Sheets

GLOVE

CROSS-REFERENCE TO RELATED APPLICATION

This application is a continuation-in-part of U.S. patent application Ser. No. 12/190,195, filed on Aug. 12, 2008, the disclosure of which is hereby incorporated by reference thereto in its entirety, and the priority of which is hereby claimed under 35 U.S.C. §120.

BACKGROUND

1. Field of the Invention

The present invention relates to gloves and, in particular embodiments, to waterproof gloves and to a process of manufacturing gloves.

2. Description of Background and Other Information

Gloves are required especially for mountain activities, such as climbing, skiing, and the like, as well as for miscellaneous other outdoor activities. Such gloves typically comprise an outer shell composed of several portions of leather or fabric sewn together at their edges. Several of such edges intersect in the area of the distal end of each finger. Because sewn edges inherently form entry points for water and moisture inside the outer shell, such gloves typically include an inner waterproof sheath, or lining. Such a lining is designed to enclose the user's hand. The finger tips of the lining provide protruding portions sewn to the shell. The walls of the lining are attached to the outer shell to delimit an inner volume. Padding is then attached inside the lining. The padding provides an improved comfort for the user and provides thermal insulation.

Such a glove suffers from several drawbacks. Because water or moisture can enter through the edges of the outer shell, the thermal insulation provided by the glove is lessened. Moreover, the cost of the waterproof or waterproof-breathable lining is relatively high. If the lining is pierced during a sewing phase, the glove is no longer waterproof. Due to its waterproofing process, including a PTFE coating step, the lining is required to be made out of two flat fabric layers joined together by bonding, such as adhesive bonding. The lining basically is made out of two flat layers having the general contour of the hand that are joined together at their respective edges, leaving an opening for insertion of the hand. Because of the flat structure of the two layers, the layers are easy to assemble, by welding, for example, thereby ensuring a waterproof assembly of the two layers. The lining then adopts a three-dimensional shape inside the outer shell. In order to delimit a suitable inner volume, a very large flat lining is initially required. In its three-dimensional shape, the lining then presents several pleats, or folds, in the area of the finger tips. The finger tips then suffer from a loss of tactile sense, making it difficult for the wearer to pick up small objects, such as coins. The finger flexibility is thereby also reduced. Seams located at the distal end of the finger shell also lead to a loss of tactile sense and to a poor appearance. Due to its loss of tactility and due to its limited finger flexibility, such a glove is not appropriate for sports such as climbing, skiing, etc. Moreover, in order to adapt to the morphology of the hand, a three-dimensional shape is required for the outer shell, which then requires complicated seam contours. Such seam contours require a complicated manufacturing process.

In the garment manufacturing field, it is known to seal and waterproof an assembly line between two panels by overlapping the assembly line with a waterproof strip. The assembly line can be a stitched line, an adhesive line, or a welded line.

Using this technology, a flat assembly is much easier to waterproof than a three-dimensional assembly. In the manufacturing of garments larger in size than gloves, the waterproofing of three-dimensional structures remains possible because the size of the various panels that are to be assembled always make it possible to "flatten" the assembly line for a certain area or for a certain length. The manufacturing of tight-fitting gloves requires the assembly of various small panels. Furthermore, when assembled together, these panels often define an acute angle between each other. This is especially the case at the finger distal end and at the finger crotch, i.e., the part of the hand that corresponds to the junction of two fingers with the remainder of the hand.

There is thus a need for a glove overcoming the aforementioned drawbacks.

SUMMARY

In addition, the invention provides a glove that increases finger tactility.

Further, the invention provides a glove that permits the area at the tip of the finger to be smooth.

Still further, the invention provides a glove that has a closer fit to conform the hand of the user, and more particularly a tight fit.

Still further, the invention provides a glove with enhanced aesthetic qualities.

Moreover, the invention provides the above-mentioned capabilities and advantages in a construction of a glove that is relatively simplified, as will become apparent from the description herein.

The invention provides a waterproof or waterproof-breathable glove that does not require a flat waterproof lining, or sheath, in its construction.

To these and other ends, the invention provides a glove that includes an outer shell comprising a plurality of finger shells, at least one finger shell including first, second, and third lobes, or tongues, the first tongue forming the palm portion of the finger shell, the second and third tongues forming the back and side portions of the finger shell, with the tongues being joined together at their adjacent edges. In a non-limiting embodiment, the glove further includes waterproof strips overlapping the adjacent edges and fastened to such edges.

In a particular embodiment, the first and second tongues are joined together by their adjacent edges located on a first side portion of the finger shell, the first and third tongues being joined together by their adjacent edges located on a second side portion of the finger shell, and the second and third tongues being joined together by their adjacent edges located on the back portion of the finger shell.

According to an embodiment, the three tongues are formed unitary from a common material.

According to another embodiment, the first, second, and third tongues are independent elements joined together. The first tongue can be made from leather and the second and third tongues can be made from fabric. Also, each of the tongues can be comprised of a laminate of two or more layers, with the layers being made of the same material or different materials. Also, one or more of the finger shells can be comprised of a foundation layer, constituting the entire extent of each of the finger shells, and an overlay that covers the foundation layer completely or partially. In an embodiment having a partial overlay, the partial overlay can comprise a material covering the foundation layer in critical areas, such as areas that are prone to abrasion. In such a case, the overlay can comprise leather or, alternatively, a synthetic material.

According to an alternative embodiment, the first, second, and third tongues can comprise a lamination of two or more materials. For example, a three-tongue foundation can be comprised of a fabric inner layer, with an outer layer of leather. In a particular embodiment, the outer layer, made of leather or other material, can be a partial layer placed, for example, in high-abrasion area(s) and omitted in area(s) so as to provide a lighter and more flexible glove. In this regard, one or more of inner layers of the tongues can be partially covered by the outer layer.

According to a particular embodiment, the three tongues are made from a waterproof or a waterproof-breathable material, or a stacked structure of multiple layers, such as layers of different materials.

The glove may include a padding delimiting an inner volume for receiving a user's hand, the padding being fastened to the outer shell and being enclosed inside the outer shell.

According to a particular embodiment, the waterproof strips are made from fabric covered by an adhesive material.

According to another particular embodiment, the waterproof strips are made out of a hot-melt adhesive material.

In a particular embodiment, the glove further includes a junction portion formed unitary with the first tongue and forms the back portion of the tip of the finger shell, the junction portion being folded over the first tongue, and the first tongue and the junction portion being joined together at their adjacent edges.

In a particular embodiment, the adjacent tongue edges are sewn together, the seams being covered by said waterproof strips.

In further embodiments the adjacent tongue edges are bonded or welded together.

The folding line of the junction portion may be located at the distal end of the finger shell, this distal end thereby having no seam, i.e., no stitching or other seam.

The tongue edges, in a particular embodiment, extend lengthwise of the finger shell.

Further consistent with particular aspects of the invention, the invention also provides a glove having an outer shell including several finger shells, wherein two adjacent finger shells are joined together at a finger crotch by respective C-shaped edges, the glove further including a sealing component overlapping the adjacent edges and fastened to such edges, the sealing component being made out of a hot-melt adhesive material.

The C-shaped edges may extend from the palm portion below the finger crotch into the back portion of the outer shell below the finger crotch.

The C-shaped edges may be located in a plane longitudinal to the hand and perpendicular to the plane of the hand.

The invention also includes a method for manufacturing a glove having several finger shells, such method including the following: forming a finger shell based on a pattern that includes first, second, and third tongues, by joining together these three tongues by their adjacent edges, the first tongue then forming a palm portion of the finger shell, the second and third tongues thus forming the back and side portions of the finger shell; and fastening the finger shell to palm and back portions of the glove. The method of the invention further comprises, in a non-limiting embodiment, fastening waterproof strips overlapping the adjacent edges.

BRIEF DESCRIPTION OF DRAWINGS

Other characteristics and advantages of the invention will be better understood from the description that follows, with reference to the annexed drawings showing, by way of non-limiting embodiments, how the invention can be made, and in which.

DETAILED DESCRIPTION

The invention is directed to a glove comprising an outer shell including several finger shells. At least one such finger shell, or as many as all of such finger shells, comprises first, second, and third lobes, or tongues. The first tongue forms the palm portion of the finger shell, i.e., the portion of the finger shell that is on the palm side of the glove. The second and third tongues form the back and side portions of the finger shell. The tongues are joined together at their adjacent edges. For embodiments of the invention structured and arranged to be waterproof, waterproof strips overlie the adjacent edges and are fastened to these edges.

Such a finger shell structure provides several advantages. A three-dimensional finger shell is obtained through the use of the three tongues. The finger shell is thus well-adapted to the shape of the hand, i.e., to the hand morphology. Moreover, the three tongues limit the number and the complexity of the seams of the finger shell, thereby simplifying construction. As a consequence, for those embodiments that include waterproofing, the fastening of waterproof strips is facilitated because the finger shell can be easily flattened. The finger shell can be typically flattened in the area of the seam along a length at least greater than 20 millimeters and, in certain embodiments, greater than 30 millimeters.

For waterproof embodiments of the invention, a waterproof sheath or lining therefore becomes unnecessary in the construction of the invention. Thus, the manufacturing costs of the glove are reduced and finger flexibility is improved. Moreover, no seam is present in the portion of the finger shell that is on the tip portion of the glove. Thus, the sense of touch and the flexion capacity of the finger are improved, whether or not the glove has a waterproof structure.

Figure 1:
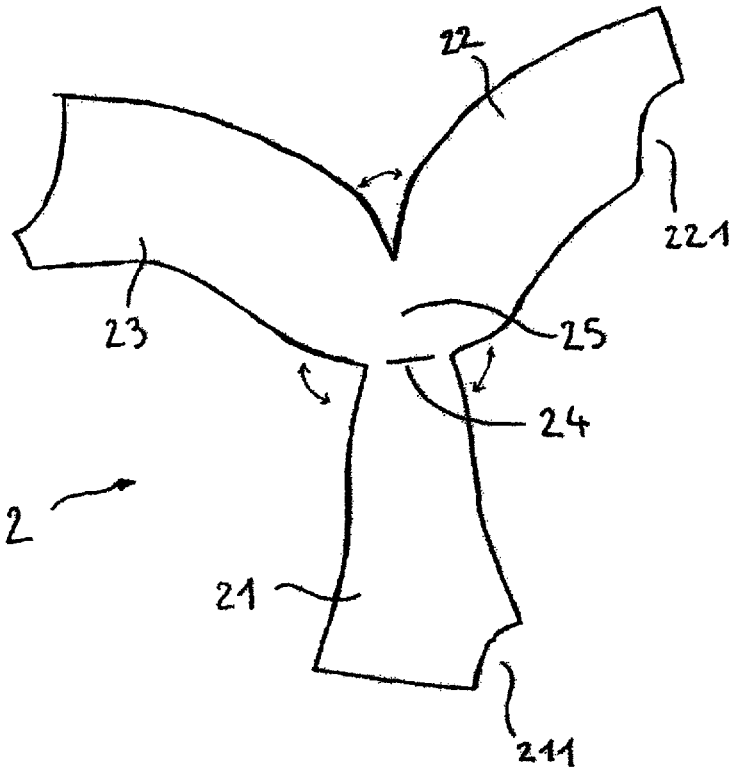
FIG. 1 is a top view of a glove finger pattern according to a first embodiment of the invention.
Figure 2:
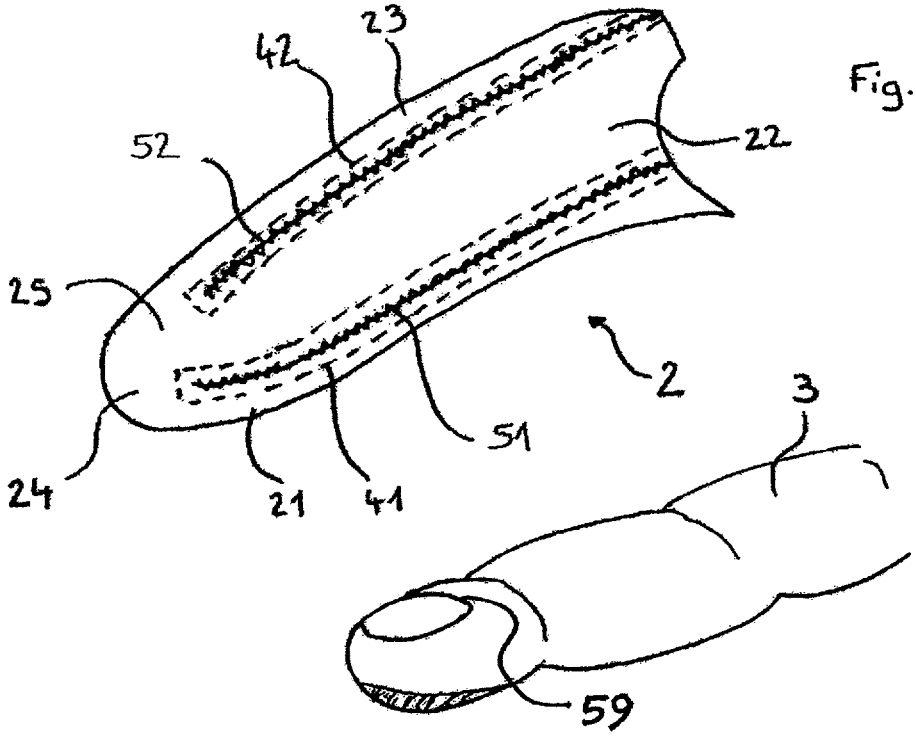
FIG. 2 is a perspective view of the assembled glove finger of FIG. 1.

FIG. 1 illustrates a pattern of a single piece of material used to form a finger shell 2. The pattern includes a first tongue 21, a second tongue 22, and a third tongue 23. The tongues 21, 22, 23 extend from a common junction portion 25 to form a Y shape. The three-dimensional shape of the finger shell 2 illustrated in FIG. 2 is obtained by joining together the adjacent edges of the tongues 21, 22, 23 of the Y-shaped pattern. Thus, the three tongues of the finger shell 2 have a combined surface area that is structured and arranged to extend transversely entirely around a wearer's finger. A wearer's finger 3 is illustrated in FIG. 2 along side the finger shell to highlight its orientation.

An edge of the tongue 21 overlaps or is adjacent an edge of the tongue 22. An edge of the tongue 21 overlaps or is adjacent an edge of the tongue 23. An edge of the tongue 22 overlaps or is adjacent an edge of the tongue 23. These overlapping or adjacent or abutting edges are sewn together in the illustrated embodiment. Each pair of adjacent edges thus presents a seam extending lengthwise of the finger shell 2. A seam 51 notably joins tongue 21 and tongue 22 on one side of the finger shell 2, thereby forming a first longitudinally extending lateral seam. A seam 52 joins tongue 22 and tongue 23 on the back portion of the finger shell 2 and can be regarded as a backside seam. Such a location of the seam 52 allows for an easy creation of variable cross sections of the finger shells, by merely increasing the widths of tongues 22 and 23 for larger sizes. A seam 53 (shown in FIG. 5) joins tongue 21 and tongue 23 on another side of the finger shell 2, thereby forming a second longitudinally extending lateral seam. As is evident from FIGS. 2 and 7, for example, the lateral seams 51 and 53 are located height-wise intermediate the top of the finger shell (at the back side) and the bottom of the finger shell (at the palm side). In the illustrated embodiment, the seams are located inside the glove to improve its appearance. As is evident from FIG. 2, as well as FIG. 5, each of the seams 51, 52, and 53 of this exemplary embodiment is substantially straight, extends longitudinally, and terminates at a free distal end. That is, the distal end of each of the seams does not intersect with another seam nor is it continuous with another seam. In the embodiment described below with reference to FIGS. 6, 7, and 8, the two lateral seams terminate at free ends, whereas the back seam 52 terminates at a transverse seam 54.

Figure 3:
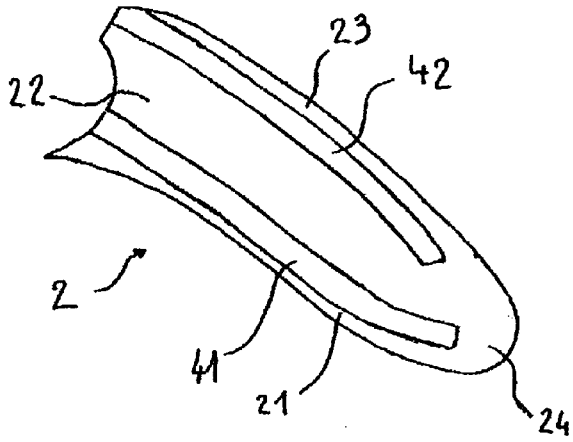
FIG. 3 is, a perspective view of the finger of FIG. 2 turned inside-out.

FIG. 3 illustrates the finger shell 2 when turned inside out. In order to seal the finger shell against water, for embodiments of the invention intended to be waterproof, the adjacent edges are overlapped by waterproof strips. The waterproof strip 41 overlaps and is fastened to the adjacent edges of tongues 21 and 22. The waterproof strip 42 overlaps and is fastened to the adjacent edges of tongues 22 and 23. A waterproof strip (not seen in FIG. 3) overlaps and is fastened to the adjacent edges of tongues 21 and 23. The waterproof strips, according to a particular embodiment, can be made of fabric covered by an adhesive layer, such as a hot-melt adhesive, for example. The waterproof strips can also be made from a waterproof material fused in contact with the adjacent edges. In a particular embodiment, the integrality of the contact surface of the waterproof strips adhere to the edges and to the seams.

In the embodiment illustrated in FIGS. 1-3, whether waterproof or not, the tongues 21, 22, 23 are made from a single material, i.e., from one and only one piece of material, which reduces the number of seams and increases the finger shell durability. Moreover, the junction portion 25 is one-piece with each of the first, second, and third tongues. The unitary form shown in FIG. 1 can be pre-cut or otherwise pre-formed, and subsequently seamed together, such as by stitching, to form the finger shell 2. The material of the unitary form can be leather or an appropriate waterproof synthetic material, or even a laminated or stacked structure of multiple layers, such as several layers, each made from the same material or from different material. The tongues of such singular material, if leather, can have leather edges that would be joined together at the aforementioned seams.

The junction portion 25 is advantageously formed unitary (i.e., in one piece) with the first tongue 21. The junction portion 25 is folded over the first tongue 21. Thus, the junction portion 25 forms the back portion of the tip 24 of the finger shell 2. Further, it can be said that the junction portion 25 forms a first back portion of the finger shell 2, with the second tongue 22 forming a second back portion and the third tongue 23 forming a third back portion, the second and third back portions extending from the first back portion in a direction away from the distal end of the finger shell. Adjacent edges of the junction portion 25 and of the first tongue 21 overlap or come together or abut. These edges are joined together by the same seams that join together tongues 22 and 23 to tongue 21. These edges are also overlapped by the above-mentioned waterproof strips. The folding line of the junction portion 25 relative to the first tongue 21 is located at the distal end 24 of the finger shell. Thus, the distal end of the finger shell 2 is smooth and rounded and has no seam. That is, the surface of the finger shell extending from the palm portion, i.e., from the first tongue 21, across the distal end or tip 24 of the finger shell, and away from the distal end within the junction portion 25 is continuous, i.e., the surface is not interrupted by an edge or a seam. This increases the sense of touch for the wearer when the glove is worn and improves the appearance of the glove. The folding line of the junction portion is practically the extension of the seam 51. Such a junction also allows flattening the finger tip 24, which is typically a portion where seams are difficult to form. For waterproof embodiments of the invention, therefore, fastening of the waterproof strips at the finger tip is thereby made easier. The lateral seams can end approximately in the area adapted to correspond to the base 59 of the fingernail of the wearer, illustrated in FIG. 5. With the illustrated embodiment, as the glove is worn, the lateral seams end at least 10 millimeters before the distal end of the finger shell, so that finger tactility can be increased.

As can be seen, none of the seams forms an acute angle. The seams, which extend along the length of the finger shell 2, are almost linear, i.e., almost straight. Thus, in the case of waterproof embodiments, the waterproofing of the seams is simplified, inasmuch as linear waterproof strips can be used and can easily be fastened onto the finger shells.

The finger shell 2 illustrated at FIGS. 1 to 3 is designed for the index finger of the left hand. An arcuate cutout 211 is made in tongue 21. Similarly, an arcuate cutout 221 is made in tongue 22. When tongues 21 and 22 are joined together, cutouts 211 and 221 form a C-shaped edge in the area of the finger crotch, as explained below with reference to FIG. 10. This C-shaped edge can be fastened to a corresponding adjacent edge of a finger shell designed for a middle finger, as also explained below, at a seam 55 covered with a sealing component 8.

Figure 4:
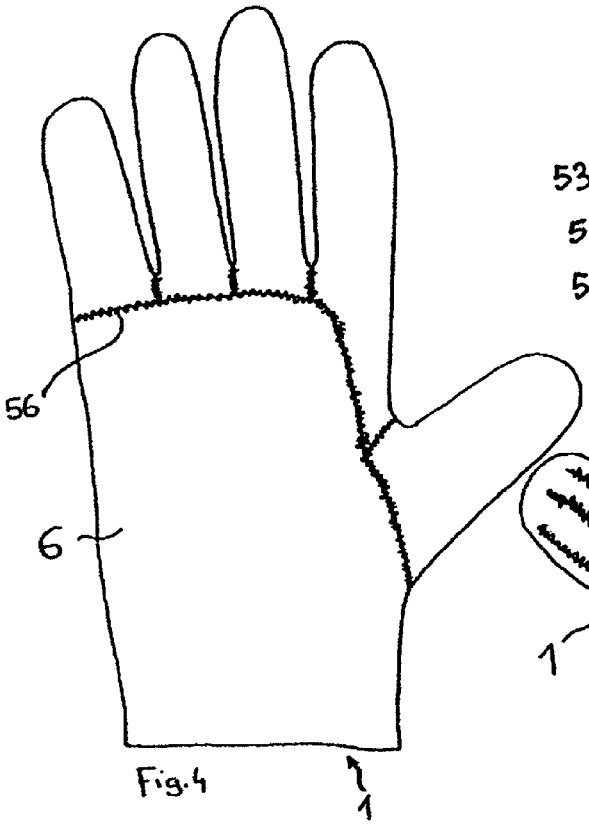
FIGS. 4 and 5 are respectively bottom and top views of a glove including several fingers according to FIGS. 2 and 3.
Figure 5:
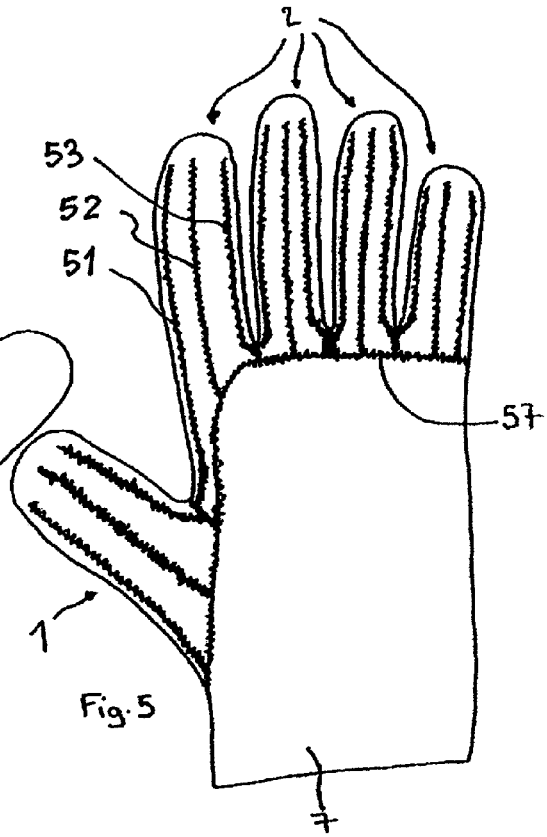

FIGS. 4 and 5 are respectively bottom and top views of the glove 1. Adjacent finger shells 2 are joined together and are fastened to a palm portion 6 and to a back portion 7 of the glove through respective seams 56 and 57. Waterproof strips (not illustrated in FIGS. 4 and 5), for waterproof embodiments of the invention, are located inside the glove, where they cover the seams 56 and 57. Further, as mentioned above, and as shown in FIG. 4, for a substantial length of the finger shells, i.e., from their distal ends toward their proximal ends, the latter being joined together as shown in FIGS. 4 and 5 and further described below, no seam joining together the tongues is present in the palm portion of the finger shell. In the top plan view of FIG. 5, showing the back side of the finger shells, the first, second and third substantially straight stitched seams 51, 52, 53 are visible. In the bottom plan view of FIG. 4, showing the palm side of the finger shells, none of the seams 51, 52, 53 are visible. Further, FIG. 5 shows that the free distal ends of the seams 51, 52, 53 are at approximately an area of the finger shell adapted to correspond to the base 59 of a wearer's fingernail.

Figure 12:
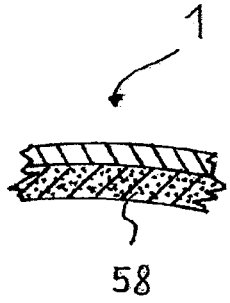
FIG. 12 is a cross section of the glove, on an enlarged scale, showing a padding positioned inside the glove.

The glove 1 may include padding 58, as shown schematically cross section in FIG. 12, e.g., inside the outer shell 4 in order to improve the thermal protection. The padding delimits an inner volume for receiving the user's hand. The padding is fastened to the outer shell, for instance by bonding, i.e., such as adhesive bonding.

Figure 6:
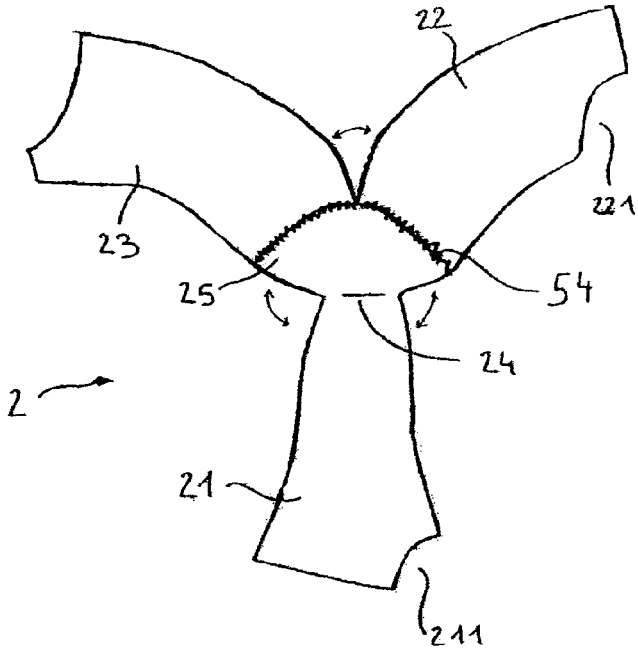
FIG. 6 is a top view of a glove finger pattern according to a second embodiment of the invention.
Figure 7:
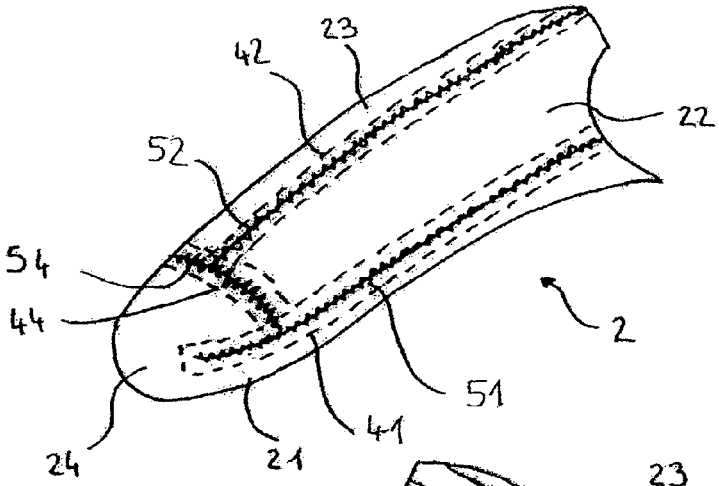
FIG. 7 is a perspective view of the assembled glove finger of FIG. 6.
Figure 8:
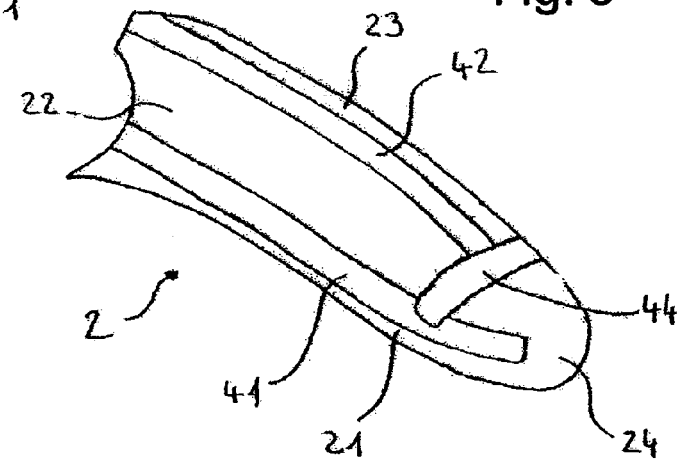
FIG. 8 is a perspective view of the finger of FIG. 7 turned inside-out.

FIGS. 6 to 8 illustrate another embodiment of the finger shell structure of a glove encompassed by the invention. Because of the pattern illustrated in FIG. 6, the material yield is significantly improved, that is, less material is required for manufacturing the glove, because the tongues 21, 22, and 23 are almost linear and can be made from individual cut-out pieces. In a non-limiting embodiment, tongue 21 is made from leather, whereas tongues 22 and 23 are made from a waterproof fabric. The junction portion 25 is advantageously formed unitary (i.e., one-piece) with the first tongue 21. Thus, the tip 24, or folding line, of the finger shell 2 is free of a joining seam, which increases the sense of touch for the user. Tongues 22 and 23 are fastened to the junction portion 25 by a seam 54, i.e., such as stitching. For each finger shell created in the manner shown in FIGS. 6-8, the wearer's finger is covered—without an intervening seam—from an area at, or near, the base of the fingernail, over the free edge of the fingernail, over the finger, and down to the base of the finger on the palm side. Not only is the sense of touch increased, but comfort to the wearer is increased. As illustrated in FIG. 8, depicting a detail of a waterproof embodiment, the seam 54 is covered by a waterproof strip 44 located inside the glove 1. In the embodiment of FIGS. 6-8, like the previously described embodiment, other than having longitudinal edge seams, such as seams 51 and 52, the tongues 21, 22, and 23 are otherwise longitudinally seamless and entirely surround the wearer's finger.

Figure 9:
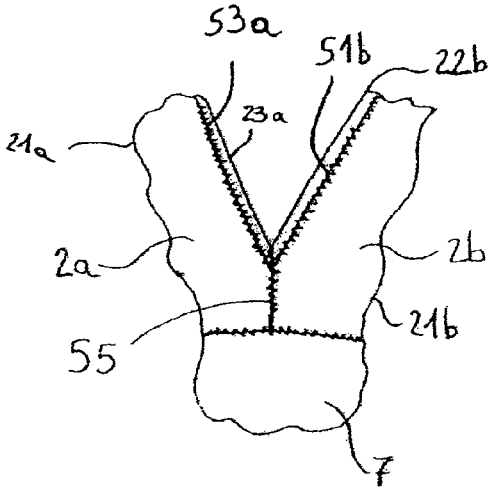
FIG. 9 is a bottom view of a glove portion at the junction between two fingers and the palm.
Figure 10:
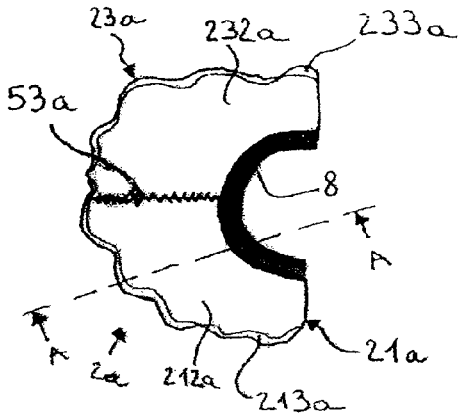
FIG. 10 is a side view of the glove portion of FIG. 9.
Figure 11:
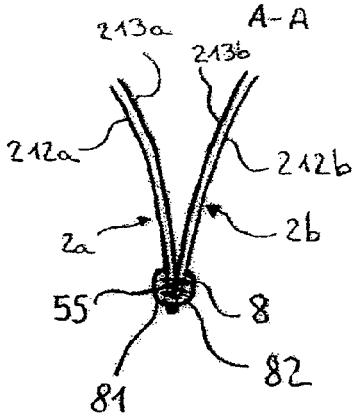
FIG. 11 is a cross section of the glove portion of FIG. 9, taken along lines 11-11.

FIGS. 9 to 11 illustrate the fastening of adjacent finger shells together at the finger crotch. Finger shells 2*a* and 2*b* are fastened to a glove back portion 7. Finger shells 2*a* and 2*b* have overlapping or adjacent edges sewn together at the finger crotch through the seam 55. These edges, each being made by means of joined cutouts of adjacent tongues, like cutouts 211, 221 of tongues 21, 22, e.g., as mentioned above, are both C-shaped in order to fit to the finger crotch morphology. With reference to the hand positioned along a vertical plane, these edges extend from the palm portion 6 (see FIG. 4, e.g.), below the finger crotch, into the back portion 7 of the outer shell, below the finger crotch. In an exemplary embodiment, these edges start at least 5 millimeters beyond the finger crotch; in another exemplary embodiment, they start at least 10 millimeters beyond the finger crotch, and, in yet another exemplary embodiment, they start at least 15 millimeters beyond the finger crotch. As illustrated, a sealing component 8, for waterproof embodiments, is located inside the glove and encloses the seam 55 and the C-shaped edges. The sealing component 8 is made out of a waterproof material or substance. Because waterproof tape might not well conform to the C-shaped edges, although encompassed by the invention, the sealing component 8 can be made from two C-shaped strips 81 and 82 made out of a hot-melt adhesive. The strips 81 and 82, in the illustrated embodiment, have the same shape. The C-shaped strips 81 and 82 can notably be made out of urethane. Each strip 81 or 82 has a portion covering a C-shaped edge and the seam 55, and a portion covering a portion of the other C-shaped strip. During assembly of the glove, the strips 81 and 82 are pressed and heated until they are joined together and are joined to their respective C-shaped edges. Once the strips 81 and 82 are joined, the protruding portion is folded back over one of the edges and heat pressed again, in order to avoid such protruding portion being a source of irritation or discomfort for the wear at the finger crotch. The strips 81 and 82 are fastened to the finger shells 2*a* and 2*b* after the tongues defining the C-shaped edges have been joined together.

Due to the sealing component 8 being made out of two C-shaped strips 81 and 82, the fastening of the finger shells at the finger crotch is made much easier. To further facilitate the fastening of the strips 81 and 82, the C-shaped edges are located in a plane perpendicular to the plane of the hand. In a particular embodiment, this plane extends longitudinally along the hand.

An appropriate pressing and heating tool will preferably have a shape that will limit the width of the portions of the strips 81 and 82 overlapping each other. The sealing component 8 will thus have a shape and a contact surface unlikely to be uncomfortable at the area of the user's finger crotch.

The finger shells 2*a* and 2*b* advantageously comprise two overlapping layers. The outer layer can be made out of leather to provide grip and abrasion resistance. The inner layer can be a moisture-permeable fabric, yet waterproof for waterproof embodiments of the invention, thus providing weather resistance and perspiration evacuation. Tongue 23*a* comprises an inner fabric layer 232*a* and an outer leather layer 233*a*. Tongue 21*a* comprises an inner fabric layer 212*a* and an outer leather layer 213*a*. Tongues 21*a* and 23*a* are joined together by the seam 53*a*. Tongue 21*b* comprises an inner fabric layer 212*b* and an outer leather layer 213*b*. Tongue 21*b* and tongue 22*b* are joined together by the seam 51*b*.

The stitching of the various panels that constitute the glove can be replaced by any other method of bonding, e.g. welding, gluing.

Figure 13A:
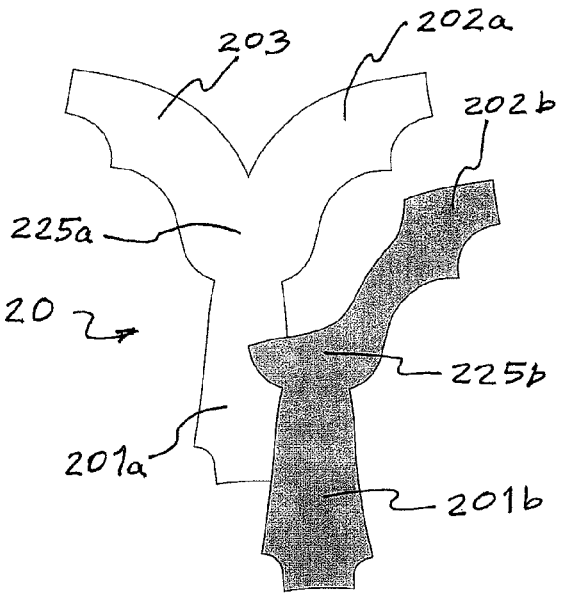
FIGS. 13*a*-13*d* are representations of an alternative embodiment of a glove finger pattern of the invention.
Figure 13B:
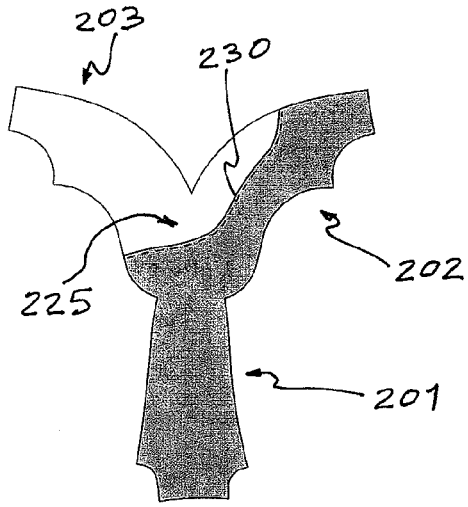

FIGS. 13*a*-13*d* illustrate different views of a pattern for forming a finger shell according to an alternative embodiment of the invention. In this embodiment, the pattern for forming a finger shell structure 20 includes a foundation and an overlay. As non-limiting possibilities, the foundation can be made of fabric, for example, and the overlay can be made of leather, for example. FIG. 13*a* shows the overlay (shaded) separated from the three-lobe foundation (unshaded) and FIG. 13*b* shows the overlay secured in place on the foundation. Although the overlay could cover the foundation completely, in the form of a laminate, the illustrated embodiment shows the overlay covering the foundation partially. As an example, the overlay can be partial so as to provide protection to the wearer in high abrasion areas only, while saving weight and providing an increased flexibility for the glove in areas not covered.

Figure 13C:
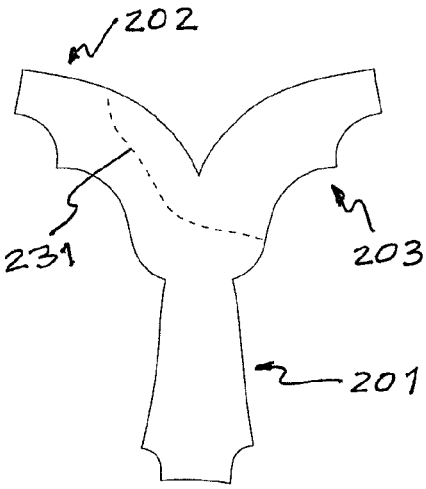
Figure 13D:
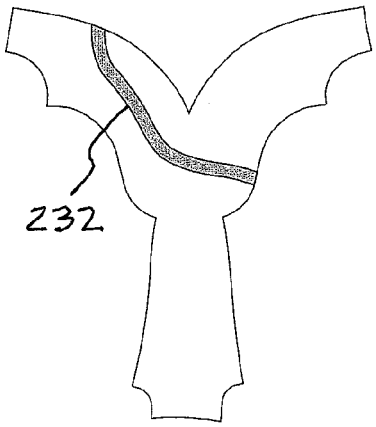

In a particular, non-limiting embodiment, the overlay is laminated to the foundation (i.e., with glue), whether the overlay only covers the foundation partially (as shown) or whether the overlay completely covers the foundation. FIGS. 13*a* and 13*b* are top views, with FIG. 13*b* showing what becomes outer exposed surfaces of a finger shell of the glove, following assembly thereof. FIGS. 13*c* and 13*d* are bottom views, showing what becomes inner surfaces of the finger shell, following assembly.

As shown in FIG. 13*b*, the three-lobe pattern of a finger shell structure 20 is comprised of a first tongue 201, a second tongue 202, a third tongue 203, and a junction portion 225. In the particular, non-limiting, illustrated embodiment, FIG. 13*a* shows the first tongue 201 to be comprised of a foundation tongue layer 201*a* and an outer tongue layer 201*b*; the second tongue 202 is comprised of a foundation tongue layer

202*a* and an outer partial tongue layer 202*b*; and the third tongue 203 is comprised only of the foundation tongue layer. In addition, the junction portion 225 is comprised of a foundation junction layer 225*a* and an outer junction layer 225*b*.

The overlay is comprised, therefore, of the following: (1) the complete first outer tongue layer 201*b* secured to the complete first foundation tongue layer 201*a*; (2) the partial outer junction layer 225*b* secured to the foundation junction layer 225*a*; and (3) the partial outer second tongue layer 202*b* secured to the second foundation tongue layer 202*a*.

Because the overlay only partially covers the foundation in the illustrated example, an edge 230 of the overlay extends along a line of the three-lobe pattern that does not correspond to, i.e., is not co-extensive with, one of the three seams (such as seams 51, 52 shown in FIG. 2 of the first embodiment) which are created when the three lobes, or tongues, are assembled together, such as by stitching 231 (see bottom view FIG. 13*c*). Although both FIGS. 13*b* and 13*c* show the edge 230 stitched in place, in an alternative embodiment the edge 230 of the overlay can be left unstitched and maintained in place with glue. If stitched, the seam along the edge 230 can be sealed if the glove is to be waterproofed. To this end, a waterproof strip 232 can be fastened over the inner surface of the stitching 231, as shown in FIG. 13*d*.

As mentioned, the foundation layer can be comprised of fabric with the overlay, whether covering the foundation layer completely or partially, can be comprised of leather. Other possibilities, however, are within the scope of the invention, including synthetic materials. The first, second, and third tongues of each layer can be made from independent elements joined together or each layer can be made as a single, unitary, piece. Also, each of the tongues can be comprised of a laminate of two or more layers, with the layers being made of the same material or different materials.

The embodiments disclosed above, and the various details of those embodiments, have been described by way of example. The invention encompasses any and all equivalent embodiments and details.

This invention illustratively disclosed herein suitably may be practiced in the absence of any element which is not specifically disclosed herein.

The invention claimed is:

1. A glove comprising:

an outer shell comprising a palm side, a back side, and a plurality of finger shells;

at least one of said finger shells comprising first, second, and third tongues;

the first tongue forming a portion of the finger shell on the palm side of the glove;

the second and third tongues forming side portions of the finger shell and respective portions of the finger shell on the back side of the glove;

adjacent pairs of edges of the first, second, and third tongues having been joined at respective seams;

a junction portion formed unitary with the first tongue, that is, the junction portion is not attached to the first tongue by means of a seam;

the junction portion forming a tip of the back portion of the finger shell, the junction portion being folded over the first tongue along a folding line;

the first tongue and the junction portion being joined together at adjacent edges.

2. A glove according to claim 1, further comprising:

waterproof strips overlap respective ones of said pairs of edges and are fastened to said adjacent edges.

3. A glove according to claim 1, wherein:

said seams extend longitudinally of the finger shell and are substantially straight;

none of said substantially straight seams are visible in a plan view of the palm side of the glove.

4. A glove according to claim 1, wherein:

the seams extend along a length of the finger shell in a direction from a base toward a distal end of the finger shell; and the seams have respective ends at approximately an area of the finger shell adapted to correspond to a base of a wearer's fingernail.

5. A glove according to claim 1, wherein:

the first and second tongues are joined together at adjacent edges located on a first side portion of the finger shell;

the first and third tongues are joined together at adjacent edges located on a second side portion of the finger shell;

the second and third tongues are joined together at adjacent edges located on the back portion of the finger shell.

6. A glove according to claim 1, wherein:

the first, second, and third tongues are independent elements joined together.

7. A glove according to claim 6, wherein:

the first tongue is made of leather and the second and third tongues are made of fabric.

8. A glove according to claim 1, wherein:

the first, second, and third tongues are made of a waterproof material.

9. A glove according to claim 1, wherein:

at least one of the first, second, and third tongues comprises a laminate of two or more layers.

10. A glove according to claim 1, wherein:

at least one of the first, second, and third tongues comprises a foundation layer and at least one partial overlying layer.

11. A glove according to claim 10, wherein:

said one partial overlying layer includes an outer exposed edge, said edge not co-extensive with any of said seam portions joining together the first, second, and third tongues.

12. A glove according to claim 11, wherein:

said edge is secured to said foundation layer with a stitched seam.

13. A glove according to claim 12, wherein:

said stitched seam is sealed with a waterproof strip fastened on an interior surface of said foundation layer.

14. A glove according to claim 1, further comprising:

a padding delimiting an inner volume for receiving a user's hand, the padding being fastened to the outer shell and being enclosed inside the outer shell.

15. A glove according to claim 1, wherein:

the waterproof strips are made of fabric covered by an adhesive material.

16. A glove according to claim 1, wherein:

the waterproof strips are made of a hot-melt adhesive material.

17. A glove according to claim 1, wherein:

said adjacent tongue edges are joined together by means of stitching, said stitching being covered by said waterproof strips.

18. A glove according to claim 1, wherein:

the folding line of the junction portion is located at a distal end of the finger shell, said distal end thereby having no seam.

19. A glove according to claim 1, wherein:

said edges of said tongues extend lengthwise of the finger shell.

20. A glove according to claim 1, wherein:

two adjacent finger shells are joined together at a finger crotch by respective C-shaped edges, the glove further comprising a sealing component overlapping adjacent ones of said C-shaped edges and fastened to said C-shaped edges, the sealing component comprising a hot-melt adhesive material.

21. A glove according to claim 20, wherein:

the C-shaped edges extend from the palm portion below the finger crotch into the back portion of the outer shell above the finger crotch.

22. A glove according to claim 20, wherein:

the C-shaped edges are located in a plane longitudinal to the hand and perpendicular to the plane of the hand.

23. A method for manufacturing a glove according to claim 1, said method comprising:

forming the one of said finger shells by joining together said first, second, and third tongues at pairs of said respective edges, the first tongue thus forming the palm portion of the one of the finger shells, the second and third tongues thus forming said back and side portions of the one of the finger shells;

fastening the one of the finger shells to palm and back portions of the glove.

24. A method according to claim 23, further comprising:

fastening waterproof strips overlapping said adjacent edges.

25. A glove according to claim 1, wherein:

the respective adjacent edges of the first and second tongues are joined at a first longitudinally extending lateral seam;

the respective adjacent edges of the first and third tongues are joined at a second longitudinally extending lateral seam;

each of the first and second lateral seams includes a respective free distal end;

each of the first and second lateral seams extends in a direction toward the distal end of the finger shell and terminates at a respective free distal end of the first and second lateral seams.

26. A glove according to claim 25, wherein:

the free distal end of each of the first and second lateral seams is spaced at least 10 millimeters from the distal end of the finger shell when the glove is worn.

27. A glove according to claim 25, wherein:

each of the first and second lateral seams is a stitched seam.

28. A glove according to claim 1, wherein:

each of the respective seams of the adjacent pairs of edges of the first, second, and third tongues comprises stitching.

29. A glove according to claim 1, wherein:

the seams extend longitudinally of the finger shell in a direction from a base toward a distal end of the finger shell; and the seams are adapted not to extend over an area of the finger shell adapted to correspond to a wearer's fingernail from a base of a the fingernail to a free end of the fingernail.

30. A glove according to claim 1, wherein:

the respective seams consist of the following:

a single backside seam formed by a pair of adjacent edges of respective ones of the second and third tongues being joined together;

a first lateral seam formed by a pair of adjacent edges of respective ones of the first and second tongues being joined together;

a second lateral seam formed by a pair of adjacent edges of respective ones of the first and third tongues being joined together;

none of the respective seams intersects with another of the respective seams, and none of the respective seams is continuous with another of the respective seams.

31. A glove comprising:

an outer shell comprising a palm side, a back side, and a plurality of finger shells;

at least one of said finger shells comprising first, second, and third tongues;

the first tongue forming a portion of the finger shell on the palm side of the glove;

the second and third tongues forming side portions of the finger shell and respective portions of the finger shell on the back side of the glove;

adjacent pairs of edges of the first, second, and third tongues having been joined at respective seams;

the first, second, and third tongues being formed unitary from a single material.

32. A glove comprising:

an outer shell comprising a plurality of finger shells, said plurality of finger shells extending longitudinally along respective ones of a wearer's fingers;

at least one finger shell of said plurality of finger shells comprising:

a junction portion comprising a distal end of said one finger shell;

a first tongue, a second tongue, and a third tongue, each of said tongues having a pair of longitudinally extending edges;

each of the first, second, and third tongues extending from the junction portion in a direction longitudinally away from the distal end of said one finger shell;

the first tongue forming at least a palm portion of said one finger shell;

the second tongue forming at least a back portion of said one finger shell;

the third tongue forming at least a back portion of said one finger shell;

the first, second, and third tongues being joined together at respective adjacent pairs of said longitudinally extending edges with respective stitched seams;

respective adjacent edges of the first and second tongues being joined at a first longitudinally extending lateral stitched seam;

respective adjacent edges of the first and third tongues being joined at a second longitudinally extending lateral stitched seam;

each of the first and second lateral stitched seams including a free distal end;

each of the first, second, and third tongues is unitary with the junction portion, that is, none of the first, second, and third tongues is attached to the junction portion by means of a fastening or a seam;

each of the first, second, and third tongues extends from the junction portion in a direction longitudinally away from said distal end of said one finger shell.

33. A glove according to claim 32, wherein:

a surface of said one finger shell, comprised of a surface of the first tongue and a surface of the junction portion, extends continuously from the palm portion of the finger shell, across the distal end of said one finger shell, and away from the distal end within the junction portion of said one finger shell.

34. A glove according to claim 32, wherein:

in a top plan view of the glove, the first and second lateral stitched seams are visible.

35. A glove according to claim 32, wherein:

the first tongue is made of leather and one of the longitudinally extending edges of each of the second and third tongues is joined to a respective leather edge of the first tongue.

36. A glove according to claim 32, wherein:

each of the first, second, and third tongues is made of leather and the respective adjacent pairs of edges of the first, second, and third tongues are pairs of leather edges.

37. A glove according to claim 32, wherein:

other than the respective stitched seams joining the respective adjacent pairs of said longitudinally extending edges, the at least one finger shell is seamless in surrounding the wearer's finger.

38. A glove according to claim 32, wherein:

the seams extend longitudinally of the finger shell in a direction from a base toward a distal end of the finger shell;

the seams are structured and arranged not to extend over an area of the finger shell adapted to correspond to a wearer's fingernail, from a base of a the fingernail to a free end of the fingernail.

39. A glove according to claim 32, wherein:

respective adjacent edges of the second and third tongues are joined together at a backside stitched seam;

none of the three seams consisting of the two lateral stitched seams and the backside stitched seam intersects with another of the three seams and none of the three seams is continuous with another of the three seams.

40. A glove according to claim 32, wherein:

each of the first and second lateral seams is located height-wise intermediate a top of the finger shell at the back portion and a bottom of the finger shell at the palm portion.

41. A glove comprising:

an outer shell comprising a palm side, a back side, and a plurality of finger shells;

at least one of said finger shells comprising first, second, and third tongues;

the first tongue forming a portion of the finger shell on the palm side of the glove;

the second and third tongues forming side portions of the finger shell and respective portions of the finger shell on the back side of the glove;

adjacent pairs of edges of the first, second, and third tongues having been joined at respective seams;

a junction portion formed unitary with the first tongue, that is, the junction portion is not attached to the first tongue by means of a seam;

the junction portion forming a tip of the back portion of the finger shell, the junction portion being folded over the first tongue along a folding line;

the respective seams consist of the following:

a single backside seam formed by a pair of adjacent edges of respective ones of the second and third tongues being joined together;

a first lateral seam formed by a pair of adjacent edges of respective ones of the first and second tongues being joined together;

a second lateral seam formed by a pair of adjacent edges of respective ones of the first and third tongues being joined together;

none of the respective seams intersects with another of the respective seams, and none of the respective seams is continuous with another of the respective seams;

each of the first and second lateral seams being located height-wise intermediate a top of the finger shell at the back portion and a bottom of the finger shell at the palm portion.

42. A glove comprising:

an outer shell comprising a palm side, a back side, and a plurality of finger shells;

at least one of said finger shells comprising first, second, and third tongues extending to a distal end of the one of said finger shells;

the first tongue forming a portion of the finger shell on the palm side of the glove;

the second and third tongues forming side portions of the finger shell and respective portions of the finger shell on the back side of the glove;

adjacent pairs of edges of the first, second, and third tongues having been joined at respective seams;

the respective seams consist of the following:

a single backside seam formed by a pair of adjacent edges of respective ones of the second and third tongues being joined together;

a first lateral seam formed by a pair of adjacent edges of respective ones of the first and second tongues being joined together;

a second lateral seam formed by a pair of adjacent edges of respective ones of the first and third tongues being joined together;

both of the first and second lateral seams extending in a direction toward the distal end farther than the single backside seam;

none of the respective seams intersecting with another of the respective seams, and none of the respective seams is continuous with another of the respective seams.

43. A glove according to claim 42, wherein:

each of the first and second lateral seams is located height-wise intermediate a top of the finger shell at the back portion and a bottom of the finger shell at the palm portion.

44. A glove according to claim 42, further comprising:

a junction portion formed unitary with the first tongue, that is, the junction portion is not attached to the first tongue by means of a seam.

* * * * *